US007998724B2

(12) United States Patent
Borole et al.

(10) Patent No.: US 7,998,724 B2
(45) Date of Patent: Aug. 16, 2011

(54) REMOVAL OF MERCURY FROM COAL VIA A MICROBIAL PRETREATMENT PROCESS

(75) Inventors: Abhijeet P. Borole, Knoxville, TN (US); Choo Y. Hamilton, Knoxville, TN (US)

(73) Assignee: UT-Battelle LLC, Oak Ridge, TN (US)

( * ) Notice: Subject to any disclaimer, the term of this patent is extended or adjusted under 35 U.S.C. 154(b) by 1098 days.

(21) Appl. No.: 11/796,173

(22) Filed: Apr. 27, 2007

(65) Prior Publication Data

US 2008/0268525 A1 Oct. 30, 2008

(51) Int. Cl.

| | |
|---|---|
| ***A61L 9/01*** | (2006.01) |
| ***C02F 3/34*** | (2006.01) |
| ***C12N 1/00*** | (2006.01) |
| ***C12N 1/12*** | (2006.01) |
| ***C12N 1/20*** | (2006.01) |

(52) U.S. Cl. ..... 435/262; 435/266; 435/822; 435/832

(58) Field of Classification Search ..... None
See application file for complete search history.

(56) References Cited

U.S. PATENT DOCUMENTS

| | | | |
|---|---|---|---|
| 4,562,156 | A | 12/1985 | Isbister et al. |
| 4,851,350 | A | 7/1989 | Stevens, Jr. et al. |
| 4,861,723 | A | 8/1989 | Madgavkar |
| 4,936,045 | A | 6/1990 | Waugh et al. |
| 5,007,620 | A | 4/1991 | Emmett, Jr. et al. |
| 5,092,909 | A | 3/1992 | Werner et al. |
| 5,246,486 | A | 9/1993 | Brierlev et al. |
| 5,259,952 | A | 11/1993 | Lee |
| 5,358,870 | A | 10/1994 | Monticello et al. |
| 5,403,365 | A | 4/1995 | Merriam et al. |
| 5,431,717 | A | 7/1995 | Kohr |
| 5,593,889 | A | 1/1997 | Valentine |
| 5,766,930 | A | 6/1998 | Kohr |
| 5,789,236 | A | 8/1998 | Jenneman |
| 5,804,435 | A | 9/1998 | Kurane et al. |
| 5,827,701 | A | 10/1998 | Lueking et al. |
| 6,124,130 | A | 9/2000 | Olson |
| 6,156,281 | A | 12/2000 | Akers et al. |
| 6,383,458 | B1 | 5/2002 | Brierley et al. |
| 6,461,859 | B1 | 10/2002 | Duhalt et al. |
| 6,905,534 | B2 | 6/2005 | Chang et al. |
| 7,101,410 | B1 | 9/2006 | Baugh et al. |
| 7,285,419 | B2 * | 10/2007 | Shade et al. ..... 436/81 |
| 2006/0096166 | A1 | 5/2006 | Brooks et al. |

OTHER PUBLICATIONS

Klasson et al., "Bio-modification of Coal to Remove Mercury", Applied Biochemistry and Biotechnology, 129-132: pp. 897-908, 2006.

Klasson et al., "Removal of Mercury from Coal via Microbial Bioleaching", U.S. Department of Energy / National Energy Technology Lab. Program Review, 2005.

* cited by examiner

*Primary Examiner* — Debbie K Ware

(74) *Attorney, Agent, or Firm* — Quarles & Brady, LLP

(57) ABSTRACT

A process for the removal of mercury from coal prior to combustion is disclosed. The process is based on use of microorganisms to oxidize iron, sulfur and other species binding mercury within the coal, followed by volatilization of mercury by the microorganisms. The microorganisms are from a class of iron and/or sulfur oxidizing bacteria. The process involves contacting coal with the bacteria in a batch or continuous manner. The mercury is first solubilized from the coal, followed by microbial reduction to elemental mercury, which is stripped off by sparging gas and captured by a mercury recovery unit, giving mercury-free coal. The mercury can be recovered in pure form from the sorbents via additional processing.

17 Claims, 5 Drawing Sheets

REMOVAL OF MERCURY FROM COAL VIA A MICROBIAL PRETREATMENT PROCESS

STATEMENT REGARDING FEDERALLY SPONSORED RESEARCH

This invention was made with United States Government support under Contract No. DE-AC05-00OR22725 between the United States Department of Energy and U.T. Battelle, LLC. The United States Government has certain rights in this invention.

CROSS-REFERENCES TO RELATED APPLICATIONS

Not Applicable.

BACKGROUND OF THE INVENTION

1. Field of the Invention

This invention relates to a process for the removal of mercury from coal by way of microorganisms that oxidize iron, sulfur and other species binding mercury within the coal.

2. Description of the Related Art

It has been reported that emissions of mercury from coal-fired burners can be in the range of 0.5-22 lbs./trillion Btu and that the power-generating industry may emit about 50 tons of mercury each year, about a third of the total manmade emissions. It has also been suggested that there may be a plausible link between mercury emissions and mercury bioaccumulation in the food chain.

Current coal-fired power plants may not be required to have dedicated mercury removal equipment, and emissions control in the combustion of coal has traditionally been limited to the removal of mercury from off-gases. In post combustion mercury removal processes, the mercury exists at very low concentrations in a flue gas which is at very high temperatures that adversely affect the efficiency of mercury sorption technologies.

In 2003, the United States Environmental Protection Agency (EPA) suggested two approaches to reduce mercury emissions. In the first approach, emissions would be reduced from 48 to 34 tons/year by 2007 using existing technology. In the second approach, emissions would be reduced by 70% by 2018. Currently, there is a debate on the amount of mercury emission reduction, with stress by regulators to reduce emissions beyond what has been proposed by EPA. Needless to say, new technologies capable of reducing mercury emissions significantly will be needed in near future.

Mercury is naturally present in coal from different world sources and it has been reported that the concentration is typically in the range of 0.02-0.4 mg/kg. In the United States, coal from the Gulf Coast and Appalachian regions generally has the highest average concentration of mercury at 0.21-0.22 mg/kg. In a comprehensive review (Toole-O'Neil et al., Fuel 78:47-54, 1999), it was concluded that mercury in coal is most likely associated with the sulfur-containing iron compounds such as pyrite; however, a fraction of the mercury may be associated with the organic matter. It is expected that mercury and sulfur are closely associated in the coal as it is known that mercury sulfide is a low-solubility inorganic salt.

Various processes have been proposed for removing mercury from coal. U.S. Pat. No. 6,156,281 discloses a process for removing mercury and other trace elements from coal containing pyrite. A slurry of finely divided coal is formed in a liquid solvent capable of forming ions or radicals having a tendency to react with constituents of pyrite or to attack the bond between pyrite and coal and/or to react with mercury to form mercury vapors. The slurry is heated in a closed container to a temperature of at least 50° C. to produce vapors of the solvent. The vapors including solvent and mercury-containing vapors are withdrawn from the closed container, and then mercury is separated from the vapors withdrawn. Another example process is found in U.S. Pat. No. 5,403,365 which describes a process for producing low mercury coal wherein heated gas is used to drive off the mercury which is then collected.

Analysis of trace metals in coal is sometimes based on leaching the coal with dilute nitric acid. In unpublished studies, as much as 75% of the mercury could be removed through nitric acid leaching, and published results summarizing data from commercial cleaning facilities suggest that 12-78% removal is possible when pyrite is removed from coal via froth floatation. Use of a two-step hydrochloric acid wash process has also been demonstrated to leach mercury from coal up to 77%.

It is known that pyrite in coal can be utilized by members of the bacteria *Acidithiobacillus* (formerly *Thiobacillus*) *ferrooxidans* (*A. ferrooxidans*), and others which use both the reduced iron and sulfur in pyrite with the overall reaction:

$$4\ FeS_2(s)+15\ O_2(g)+2H_2O(l)\text{-->}2\ Fe_2(SO_4)_3(aq)+2H_2SO_4(aq).$$

This reaction is stepwise beginning with the interaction between the pyrite surface and soluble Fe(III) to liberate elemental sulfur, S(0), and Fe(II). Fe(II) and S(0) are oxidized by the bacteria, yielding the overall reaction above. The reactions are carried out by the bacterium *A. ferrooxidans* or by two bacteria (*A. ferrooxidans* and *A. thiooxidans*) working together. The generation of sulfuric acid in the process lowers the pH and helps with further dissolution of pyrite, and will aid in the dissolution of mercury-sulfur compounds. The optimal pH for iron removal from coal pyrite was determined to be pH 2 in experiments with *A. ferrooxidans* (see Torma et al., *Appl. Biochem. Biotechnol.* 18:341-354, 1988). This pH is naturally obtained through the release of sulfuric acid by the bacteria. See also, U.S. Pat. Nos. 5,827,701 and 4,861,723, which are incorporated herein by reference along with all other patents and publications cited herein.

Another organism with good metal bioleaching capability is *Leptospirillium ferrooxidans* (*L. ferrooxidans*). This organism was found to comprise more than a 50% population in microbial species habitating biotopes such as mines and surrounding dump sites at temperatures above 20° C. Other reports also suggest the dominance of *Leptospirillum* genus in acid mine drainage environments. This is a strict chemolithoautrotroph, metabolizing ferrous iron and pyrite.

Microbial leaching for copper and uranium recovery has been used commercially for low-grade ore. Other metals including nickel, copper, and lead have also been studied for bioleaching potential using the same organisms. Other example biooxidation processes can be found in U.S. Pat. Nos. 6,383,458 and 5,007,620.

However, commercial technology for the precombustion removal of mercury from coal is not believed to be available at this time. Therefore, there is a need for a coal modification technique that will aid in the removal of mercury from coal prior to thermal processing.

SUMMARY OF THE INVENTION

The present invention provides a process for the removal of mercury from coal. The mercury bound to coal is transformed from inorganic forms to elemental mercury form and is removed from the coal and/or associated liquid via gas sparging into the gas phase. The separation of the mercury from the coal takes place via microbial action. The microbes can be a pure culture or it can be a microbial consortium. The mercury can be separated from the gas phase by sorption onto traps having high affinity for mercury. The mercury-stripped gas can be recycled back into the bioreactor containing the coal and the microbial culture. The mercury can then be desorbed from the traps and used for beneficial purposes.

In one aspect, the invention provides a process for removing mercury from coal. In the process, coal having associated mercury or mercury compounds is contacted with a liquid including iron-oxidizing bacteria and/or sulfur-oxidizing bacteria. Iron, iron compounds, sulfur, and/or sulfur compounds in the coal are biooxidized by the bacteria such that mercury and/or mercury ions are released from the coal and/or into the liquid. The mercury ions in the liquid are volatilized into mercury by the bacteria. A first gas is passed over the coal and/or into the liquid to release a second gas from the coal and/or liquid. The second gas includes volatilized elemental mercury.

The microorganisms are preferably selected from *Acidithiobacillus ferrooxidans, Acidithiobacillus thiooxidans, Acidithiobacillus caldus, Leptospirillium ferrooxidans, Sulfolobus solfataricus*, and mixtures thereof. The most preferred microorganism is *Acidithiobacillus ferrooxidans*. Depending on the microorganisms used in the process, temperatures in the range of about 4° C. to about 95° C., and a pH of about 0.5 to about 6 may be preferred in the process.

In the process, the second gas may be treated to remove and/or recover mercury. In one version of the process, the coal is contacted with the liquid in an enclosed bioreactor, and a stream of the second gas is fed from the enclosed bioreactor through a gas collection system and then through a mercury recovery unit such as an adsorption system, an ion exchange system, a condenser system, a gold-coated sand trap, or a resin bed. The treated second gas exiting the mercury recovery unit may be reused by mixing with the first gas that is passed into the coal and liquid. In another version of the process, the coal is contacted with the liquid in an enclosed bioreactor, and effluent liquid is removed from the bioreactor and treated to recover sulfates and/or iron and/or other heavy metals from the effluent liquid. The treated effluent liquid may be reintroduced into the bioreactor. Optionally, the effluent liquid may be filtered to remove coal or coal fines after removal from the bioreactor.

In another version of the process, the coal is contacted with the liquid in an enclosed bioreactor, and the first gas is passed over the coal and/or into the liquid by way of a sparging device located in the bioreactor. When the mixture in the bioreactor is a slurry of the coal and the liquid, the slurry may be agitated with a stirrer or mixer.

In another aspect, the invention provides a heap process for removing mercury from coal. In the heap process, a heap including (i) coal having associated mercury or mercury compounds and (ii) a liquid including microorganisms selected from the group consisting of iron-oxidizing bacteria, sulfur-oxidizing bacteria, and mixtures thereof, is formed. Iron, iron compounds, sulfur, and/or sulfur compounds in the coal are biooxidized by the bacteria such that mercury and/or mercury ions are released from the coal into the heap. The mercury ions in the heap are volatilized into mercury. A first gas is introduced into the heap to release a second gas from the heap. The second gas includes volatilized mercury. A stream of the second gas is fed through a mercury recovery unit to recover mercury from the second gas. Suitable microorganisms for the coal heap process are *Acidithiobacillus ferrooxidans, Acidithiobacillus thiooxidans, Acidithiobacillus caldus, Leptospirillium ferrooxidans, Sulfolobus solfataricus*, and mixtures thereof.

In yet another aspect, the invention provides a slurry process for removing mercury from coal. In the slurry process, a slurry including (i) coal having associated mercury or mercury compounds and (ii) a liquid including microorganisms selected from the group consisting of iron-oxidizing bacteria, sulfur-oxidizing bacteria, and mixtures thereof, is formed. Iron, iron compounds, sulfur, and/or sulfur compounds in the coal are biooxidized by the bacteria such that mercury and/or mercury ions are released from the coal into the slurry. The mercury ions in the slurry are volatilized into mercury. A first gas is introduced into the slurry to release a second gas from the slurry. The second gas includes volatilized mercury. A stream of the second gas is fed through a mercury recovery unit to recover mercury from the second gas. Suitable microorganisms for the coal slurry process are *Acidithiobacillus ferrooxidans, Acidithiobacillus thiooxidans, Acidithiobacillus caldus, Leptospirillium ferrooxidans, Sulfolobus solfataricus*, and mixtures thereof.

Thus, it is an advantage of the present invention to provide a process that can be used to remove mercury from coal prior to combustion.

It is another advantage to provide a process that eliminates the need to implement a post-combustion mercury removal process.

It is yet another advantage to provide an environmentally friendly process for mercury removal from coal compared to existing technologies.

These and other features, aspects, and advantages of the present invention will become better understood upon consideration of the following detailed description, drawings and appended claims.

DETAILED DESCRIPTION OF THE INVENTION

The biological process for mercury removal according to the invention includes the steps of contacting coal with a microbial culture, either in a batch or a continuous mode. This results in solubilization of the mercury from the coal, followed by volatilization of mercury ions, such as Hg(II), to elemental mercury, also mediated by the bacteria. The mercury is subsequently removed from the gas phase by sorption on suitable sorbent materials or using mercury traps. The mercury may be recovered from the sorbents or traps via simple heating or further processing, thereby regenerating the sorbents for reuse.

Figure 1:
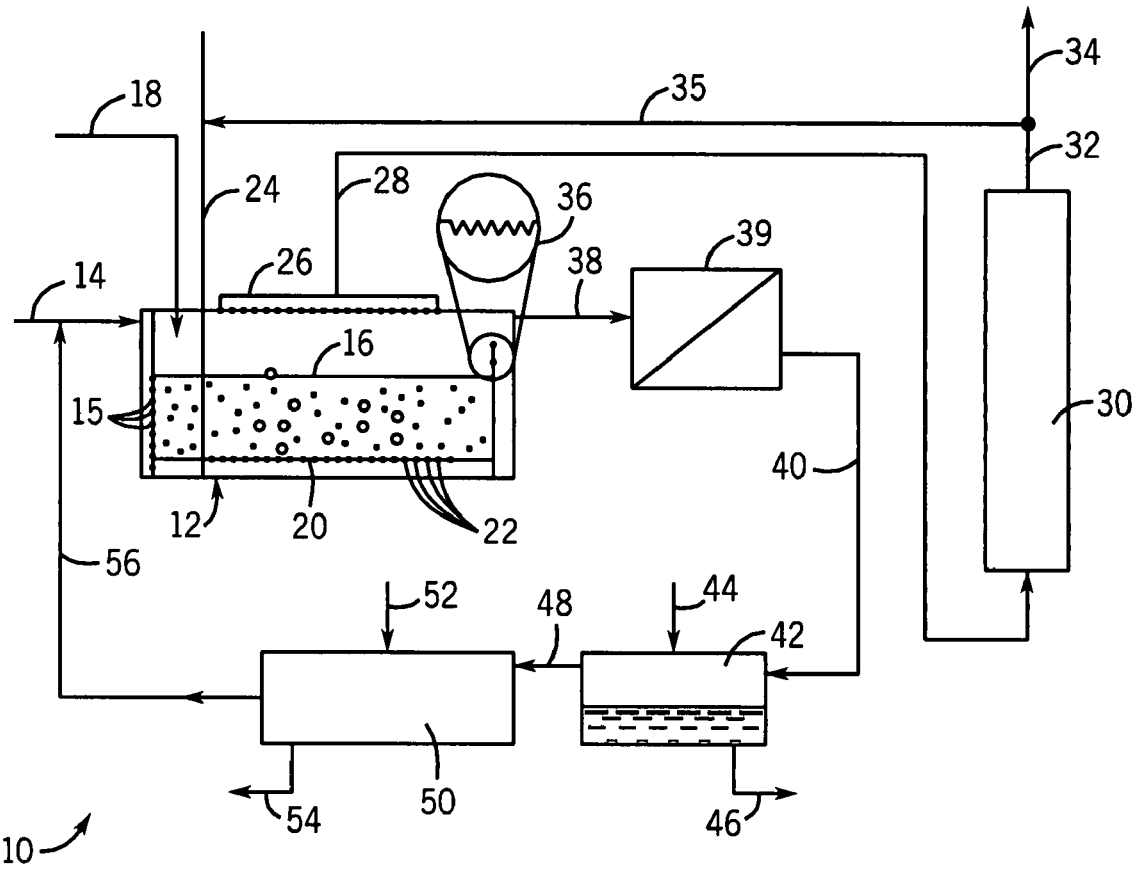
FIG. 1 is a process schematic for mercury removal from coal in a heap process according to the invention.

Turning now to FIG. 1, there is shown a process schematic for mercury removal from coal in a horizontal flow heap process in which the microbial dissolution and volatilization of mercury takes place. A heap process system 10 according to the invention includes an enclosed coal heap bioreactor 12 for containing coal, water and biocatalyst such as microorganisms selected from the group consisting of iron-oxidizing bacteria, sulfur-oxidizing bacteria, and mixtures thereof. The enclosed coal heap bioreactor 12 may be airtight. The coal has associated mercury or mercury compounds before treatment in the process. As used herein, mercury or mercury compounds are "associated" with the coal if the mercury or mercury compounds are directly or indirectly, physically and/or chemically bound to the coal.

The heap bioreactor 12 receives water and/or other liquids via conduit 14 that is in fluid communication with fluid delivery ports 15 that are vertically arranged adjacent to one side of the coal heap 16. Coal is provided to the coal heap 16 via coal inlet conduit 18. Sparging gas is introduced into a lower section of the coal heap 16 by way of a horizontal sparging tube 20 that has outlet ports 22 that introduce gas into the coal heap 16. The sparging tube 20 receives gas from gas inlet conduit 24. The sparging tube 20 may have various shapes such as circular, straight, oval, or spiral. Preferably, the outer edge to outer edge length of the sparging tube 20 is longer than half the diameter of the coal heap 16. Nonlimiting examples of the sparging gas include air, oxygen, nitrogen, carbon dioxide, noble gases, and mixtures thereof. The sparging gas moves upward through the coal heap 16. The biocatalyst microorganisms may be introduced into the coal heap 16 by way of the conduit 14, the coal inlet conduit 18, or any other suitable means for introducing the biocatalyst microorganisms into the coal heap 16.

The heap process system 10 further includes a gas collection system 26 in fluid communication with the enclosed coal heap bioreactor 12. The gas collection system 26 may be maintained at a lower pressure level which causes the gas released above the surface of the heap 16 to flow toward the gas collection system 26. A conduit 28 is in fluid communication with the gas collection system 26 for directing an effluent gas stream from the gas collection system 26 to a mercury recovery unit 30 which removes mercury from the effluent gas stream. A conduit 32 receives treated mercury-free effluent gas from the mercury recovery unit 30. Treated gas from the conduit 32 may be directed to the atmosphere through vent conduit 34 and/or directed back by conduit 35 to gas inlet conduit 24 for reuse in the sparging tube 20.

There are various non-limiting examples of mercury recovery units suitable for use in the heap process system 10. The mercury recovery unit may be an activated carbon adsorption system. The mercury recovery unit may be a zeolite ion exchange system. The mercury recovery unit may be a mercury trap through which a refrigerant is circulated. The mercury trap includes a cold surface on which droplets of condensed mercury vapor are collected and from which they are directed into a container. The mercury recovery unit may be a room temperature gold-coated sand trap in which mercury sticks to the gold coating. The mercury recovery unit may achieve mercury removal with an organic resin in a fixed bed configuration. In one form, the resin may include a polystyrene backbone covalently bonded to a functional group, such as a thiol (—SH) group, which is responsible for removing mercury. The mercury trapped in the mercury recovery unit 30 may be recovered in order to regenerate the mercury trapping media for further use. For example, mercury may be released from activated carbon sorbents or gold-coated sand by heating. Mercury may be removed from resin beds with certain eluting liquids.

The heap process system 10 further includes a V-shaped overflow weir 36 in fluid communication with the enclosed coal heap bioreactor 12. A fluid conduit 38 delivers effluent liquid from the weir 36 to a cross flow filtration system 39. The cross flow filtration system 39 may be used, for example, to remove coal fines from the effluent liquid. A nonlimiting example cross flow filtration system can be found in U.S. Pat. No. 5,259,952.

A fluid conduit 40 delivers filtered effluent liquid from the cross flow filtration system 39 to an iron precipitation tank 42. Basic hydroxides, such as sodium hydroxide, potassium hydroxide or calcium hydroxide, are delivered to precipitation tank 42 by way of conduit 44. Precipitated iron hydroxides are removed from the precipitation tank 42 by way of conduit 46.

A fluid conduit 48 delivers treated filtered effluent liquid from the iron precipitation tank 42 to a sulfate precipitation tank 50. The sulfates in the treated filtered effluent liquid are removed in the sulfate precipitation tank 50 where lime (CaO) is added by way of conduit 52 to the sulfate containing treated filtered effluent liquid. The sulfates are precipitated as calcium sulfates which are removed as a sludge by way of conduit 54. The treated water from the sulfate precipitation tank 50 may be recycled back to conduit 14 by way of conduit 56 thereby allowing reuse of the treated water in the coal heap bioreactor 12.

Figure 2:
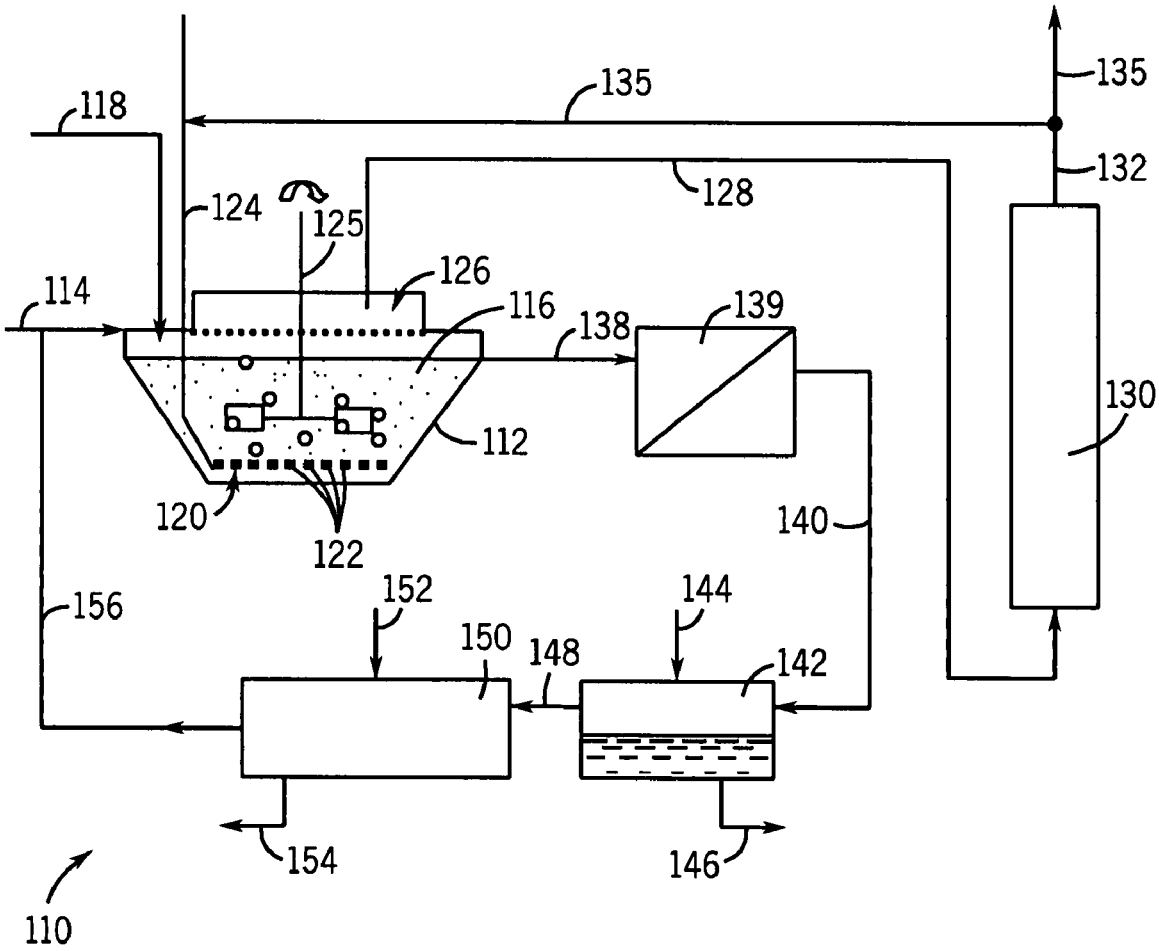
FIG. 2 is a process schematic for mercury removal from coal in a slurry process according to the invention.

Referring now to FIG. 2, there is shown a process schematic for mercury removal from coal in a slurry process in which the microbial dissolution and volatilization of mercury takes place. A slurry process system 110 according to the invention includes an enclosed coal slurry bioreactor 112 for containing coal, water and biocatalyst such as microorganisms selected from the group consisting of iron-oxidizing bacteria, sulfur-oxidizing bacteria, and mixtures thereof. The enclosed coal slurry bioreactor 112 may be airtight. The coal has associated mercury or mercury compounds before treatment in the process.

The slurry bioreactor 112 receives water and/or other liquids via conduit 114 that is in fluid communication with the slurry bioreactor 112. Coal is provided to the coal slurry 116 in the slurry bioreactor 112 via coal inlet conduit 118. Sparging gas is introduced into a lower section of the slurry bioreactor 112 by way of a horizontal sparging tube 120 that has outlet ports 122 that introduce gas into the coal slurry 116. The sparging tube 120 receives gas from gas inlet conduit 124. The sparging tube 120 may have various shapes such as circular, straight, oval, or spiral. Suitable sparging gases are noted above. The sparging gas moves upward through the coal slurry 116. The biocatalyst microorganisms may be introduced into the coal slurry 116 by way of the conduit 114, the coal inlet conduit 118, or any other suitable means for introducing the biocatalyst microorganisms into the coal slurry 116. A rotating stirrer 125 may be included in the coal slurry bioreactor 112 to agitate the coal, water and biocatalyst slurry in the coal slurry bioreactor 112.

The slurry process system 110 further includes a gas collection system 126 in fluid communication with the slurry bioreactor 112. The gas collection system 126 may be maintained at a lower pressure level which causes the gas released above the surface of the coal slurry 116 to flow toward the gas collection system 126. A conduit 128 is in fluid communication with the gas collection system 126 for directing an effluent gas stream from the gas collection system 126 to a mercury recovery unit 130 which removes mercury from the effluent gas stream. A conduit 132 receives treated mercury-free effluent gas from the mercury recovery unit 130. Treated gas from the conduit 132 may be directed to the atmosphere through vent conduit 134 and/or directed back by conduit 135 to gas inlet conduit 124 for reuse in the sparging tube 120. The non-limiting examples of mercury recovery units for use with the heap process system 10 are also suitable for use in the slurry process system 110.

A fluid conduit 138 delivers effluent liquid and solids from the coal slurry bioreactor 112 to a cross flow filtration system 139 by way of a pump. The cross flow filtration system 139 may be used, for example, to remove coal from the effluent liquid. A nonlimiting example cross flow filtration system can be found in U.S. Pat. No. 5,259,952.

A fluid conduit 140 delivers filtered effluent liquid from the cross flow filtration system 139 to an iron precipitation tank 142. Basic hydroxides, such as sodium hydroxide or potassium hydroxide, are delivered to precipitation tank 142 by way of conduit 144. Precipitated iron hydroxides are removed from the precipitation tank 142 by way of conduit 146.

A fluid conduit 148 delivers treated filtered effluent liquid from the iron precipitation tank 142 to a sulfate precipitation tank 150. The sulfates in the treated filtered effluent liquid are removed in the sulfate precipitation tank 150 where lime (CaO) is added by way of conduit 152 to the sulfate containing treated filtered effluent liquid. The sulfates are precipitated as calcium sulfates which are removed as a sludge by way of conduit 154. The treated water from the sulfate precipitation tank 150 may be recycled back to conduit 114 by way of conduit 156 thereby allowing reuse of the treated water in the slurry bioreactor 112.

In the slurry process system 110, water and coal may be continuously introduced to the slurry bioreactor 112, and the slurry may be continuously pumped from the slurry bioreactor 112 to the cross flow filtration system 139 for removal of the treated coal. Alternatively, the slurry may be maintained in the slurry bioreactor 112 for a set treatment time period, and the slurry may be thereafter completely pumped over a time period from the slurry bioreactor 112 to the cross flow filtration system 139 for removal of the treated coal. Optionally, the coal may be crushed, milled, pulverized or ground before introduction into the slurry bioreactor 112.

In either the heap process system 10 or the slurry process system 110, at least one of iron, iron compounds, sulfur, and sulfur compounds in the coal are biooxidized by iron-oxidizing or sulfur-oxidizing microorganisms such that mercury and/or mercury ions are released into the liquid in the coal heap 16 or coal slurry 116. The mercury ions in the liquid are then volatilized into elemental mercury. Nonlimiting example microorganisms include *Acidithiobacillus ferrooxidans, Acidithiobacillus thiooxidans, Acidithiobacillus caldus, Leptospirillium ferrooxidans, Sulfolobus solfataricus*, and mixtures thereof. The sparging gas introduced into the coal heap 16 or coal slurry 116 releases a second gas above the coal heap 16 or coal slurry 116. The second gas includes volatilized mercury which is collected in the mercury recovery unit 30 or mercury recovery unit 130 as described above.

A microbial culture used in the invention can be prepared by inoculation of a pure culture of microorganisms or a microbial consortium into a nutrient medium which is incubated at a suitable temperature. An example bacteria used in the experiments below is *Acidithiobacillus ferrooxidans* and it may be grown at 30° C. An exponentially growing culture is most ideal for the process. The organism suitable for this process should be an iron-oxidizing bacteria or sulfur-oxidizing bacteria, most of which are acidophilic organisms. Any organism from this class may also be used for the process, including thermophilic organisms, although the effectiveness of each organism is different and depends, also on the type of coal being processed. Once a culture is grown using a suitable growth medium for the organism being used, the cells are collected by centrifugation or gravity settling. In the case of iron-oxidizing bacteria, Fe(III) will be produced which will form a precipitate during growth of the organism. The cells can be collected with or without the iron (III) precipitate. Separation of the iron precipitate may be achieved using the following process.

Example protocol for harvesting cells without iron precipitate:

1. Centrifuge the growth culture at 6000 rpm for 30 minutes at 4° C. Discard supernatant.
2. Combine pellets in sterile 4° C. Milli-Q™ water at pH 2.6 (acidified with 20% $H_2SO_4$) in a 250 ml. media bottle.
3. Shake cell suspension hard for 2 minutes and store at 4° C.
4. On day 2, transfer supernatant to a sterile 500 ml. media bottle and store at 4° C. This is the cell suspension.
5. Resuspend precipitate with ~75 ml. sterile 4° C. Milli-Q™ water at pH 2.6, shake hard and store at 4° C.
6. Repeat steps 4 & 5 two more days and transfer the cell suspension to the media bottle started in step #4.
7. On day 4, centrifuge the collected cell suspension at 10,000 rpm for 20 minutes at 4° C. in a sterile 250 ml. centrifuge bottle.
8. Discard supernatant and combine pellets with ~15 ml. sterile 4° C. Milli-Q™ water at pH 3.5 (acidified with 20% $H_2SO_4$) in a 50 ml. centrifuge tube.
9. Centrifuge cell suspension at 12,500 rpm for 20 minutes at 4° C. Discard supernatant and transfer resuspend pellet in 14 ml. sterile 4° C. Milli-Q™ water at pH 3.5 to a sterile tube.
10. Store cell suspension in 4° C. It is preferred to eliminate this step if at all possible, since storage of the cells at a lower temperature can lead to a lag time in initiating the bioconversion process.

The culture may also be used directly for contacting with coal, without separation from the culture media. This was the form of the biocatalyst for the Examples below to demonstrate the mercury removal from coal.

EXAMPLES

The following Examples have been presented in order to further illustrate the invention and are not intended to limit the invention in any way.

The nutrient medium used for growth of the Acidithiobacillus ferrooxidans microorganisms and/or for cell wash and storage is given in Table 1.

TABLE 1

ATCC 2039 Nutrient Medium And Fe(III) Medium

| Solution A: | Solution B: |
|---|---|
| 0.8 g. $(NH_4)_2S0_4$<br>2.0 g. $MgS0_4 \cdot 7H_20$<br>0.4 g. $K_2HP0_4$<br>5 ml. Wolfe Minerals<br>800 ml. $diH_20$ | 20 g. $FeS0_4 \cdot 7H_20$<br>200 ml. $diH_20$ |

Adjust pH to 2.3 for both solutions using 20% $H_2S0_4$. Combine solutions after 0.45 μm filter sterilization.

| | |
|---|---|
| Fe(II) medium | Dissolve 1.75 g. $FeS0_4 \cdot 7H_20$ in 17.5 ml. Milli-Q $H_20$.<br>Adjust pH to 2.3 with 20% $H_2S0_4$.<br>Combine this with 70 ml. Solution A (ATCC 2039).<br>Adjust the pH again to 2.3 (final volume: 100 ml.) |
| Fe(III) medium | Dissolve 0.129 g. $Fe_2(S0_4)_3 \cdot 1.5H_20$ in 50 ml. Milli-Q $H_20$.<br>Adjust pH to 2.3 with 20% $H_2S0_4$.<br>combine 2 ml. of this with 100 ml. Solution A (ATCC 2039).<br>Adjust pH again to 2.3. |

Below are three experiments to demonstrate the process. In the first experiment, conversion of $Hg^{+2}$ to elemental mercury was verified for the strain being used in this study. In this experiment, no coal was used, but $Hg^{+2}$ was added in form of mercuric chloride. In the second and third experiment, mercury removal from coal was studied. The difference in these latter experiments was the volume of the slurry used, 50 mL vs. 1 L.

In the first experiment, a culture of *A. ferrooxidans* was grown in a 75 ml. serum bottle with 4 g/L $Fe^{+2}$. The cells were harvested without the iron precipitate and inoculated into a 50 mL media containing 100 mg/L $Fe^{+2}$ in a serum bottle. This culture was grown until $Fe^{+2}$ was depleted to ~50 mg/L. Following this, mercury was added in the form of mercuric chloride (2 μg/L) to the culture and conversion of $Hg^{+2}$ to elemental mercury was monitored.

The second experiment was a batch process designed to demonstrate the mercury bioleaching and volatilization from coal. In this experiment, 1.0 g. of coal was contacted with a 50 mL culture and the mercury conversion was monitored for a period of 8 days. A control experiment was conducted in parallel with the 50 mL experiment. The control was setup without microorganisms. It contained only the nutrient medium and the coal. A 50 mL culture was amended with 200 mg/L $Fe^{+2}$. The cells were allowed to grow until majority of the ferrous ions were consumed. When the $Fe^{+2}$ concentration was ~50 mg/L, a test of the ability of the biocatalyst to volatilize mercury was conducted. This was done by adding $Hg^{+2}$ (250 pg=5 ng/L) in the form of mercuric chloride. The conversion of $Hg^{+2}$ to elemental mercury was monitored by measuring elemental mercury in the gas phase. The serum bottles were sparged with air-$CO_2$ mixture at a flow rate of 20 mL/min. The results indicated that about 100 pg of the $Hg^{+2}$ added was converted to elemental mercury in about 4 hours. The amount of mercury released from the control was believed to be negligible. This implies that the mercury reduction from $Hg^{+2}$ to $Hg^0$ is microbially mediated, using *A. ferrooxidans* as the biocatalyst. The coal was added to both, the experimental and control serum bottles at this time. The levels of $Fe^{+2}$, Fe(total), and sulfate in the liquid phase and Hg in the gas phase were monitored over the next 8 days to investigate mercury release from coal.

In the third experiment (1 L bioreactor), the nutrient medium containing 8 g/L of $Fe^{+2}$ (ferrous sulfate) was inoculated with 20 mL of stock culture of *A. ferrooxidans*. The operating temperature was 30° C. The reactor was sparged continuously with air containing up to 10% carbon dioxide. The flow rate of the gas in 1 L reactors was about 200 mL/min. The cells were allowed to grow for a period of 3 days, at which point the $Fe^{+2}$ concentration was <2 g/L. The ability of the cells to reduce mercuric ions was tested by adding 500 pg (=0.5 ng/L) of $Hg^{+2}$. The added mercuric ions were volatilized to elemental mercury in less than one hour. Subsequently, 1.1 g. of coal was added into the culture. The levels of $Fe^{+2}$, Fe(total) in the aqueous phase and mercury in the gas phase were monitored similar to the 50 mL culture for the next 12 days.

The mercury in the gas phase was measured using a CVAFS (cold vapor atomic fluorescence spectroscopy) instrument (Model III, Brooks Rand, Calif., USA). The mercury from the reactor effluent was trapped on a gold-coated sand trap and subsequently measured by elution with a heated nichrome wire set up. The rate of mercury volatilization was measured by trapping mercury over a period of one hour or continuously/overnight.

Results

Figure 3:
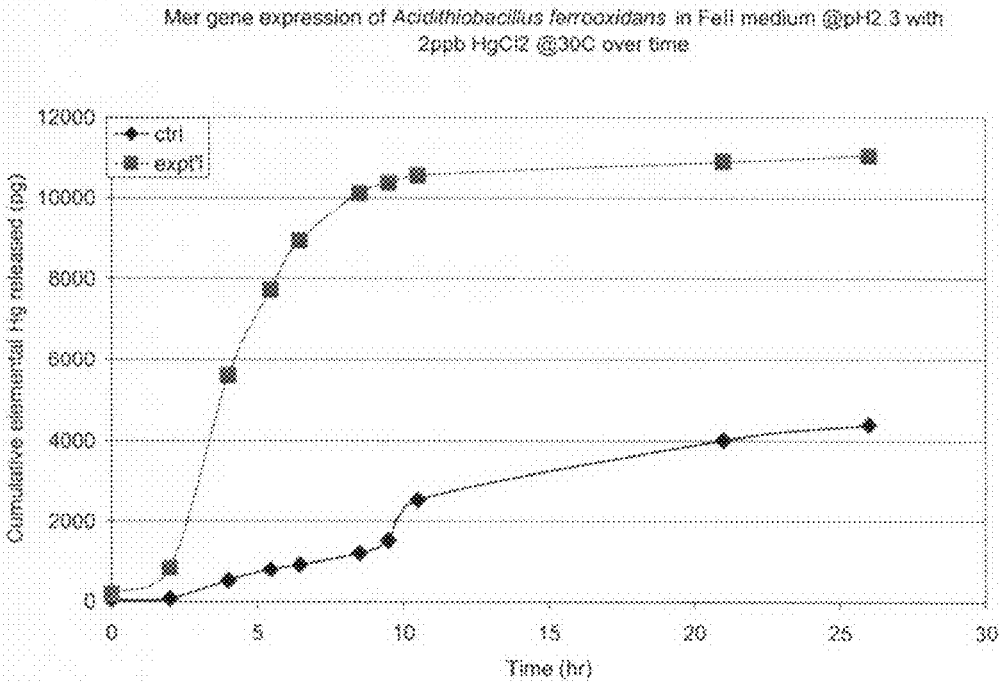
FIG. 3 is a graph showing the conversion of $Hg^{+2}$ to $Hg^{0}$ by *Acidithiobacillus ferrooxidans*.

The results of the first experiment demonstrating conversion of $Hg^{+2}$ to $Hg^0$ by *A. ferrooxidans* are shown in FIG. 3. The conversion of the mercuric ions to elemental mercury begins within two hours. The rate of mercury conversion based on the initial rate (2-5 hours) is 2.38 ng/hr. It is believed that this rate is not optimized and therefore it is not the maximum rate achievable.

Figure 4:
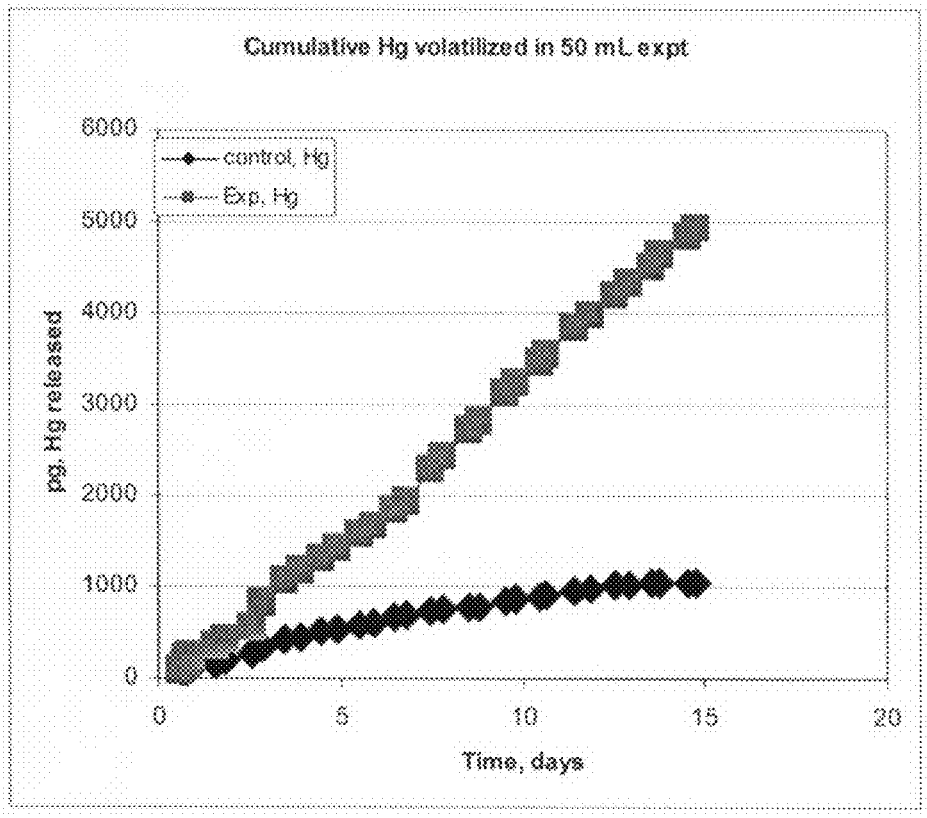
FIG. 4 is a graph showing the rate of mercury volatilization from coal into the gas phase in a 50 mL slurry experiment.
Figure 5:
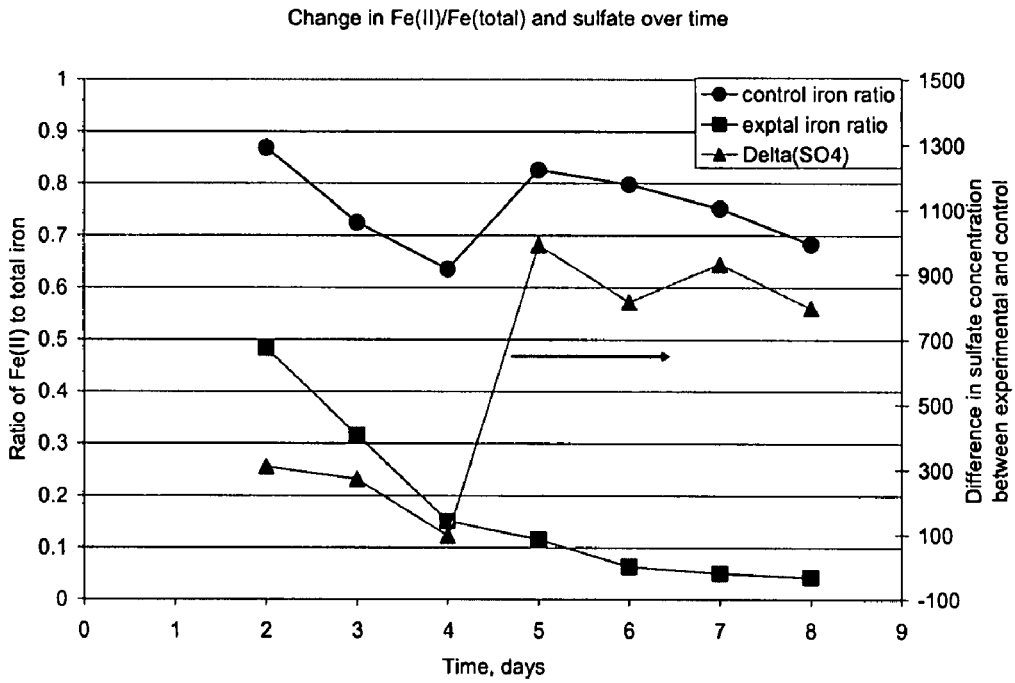
FIG. 5 is a graph showing the oxidation of iron and pyritic sulfur indicated by increase in ratio of Fe(II) to total iron and production of sulfate in liquid slurry phase during a coal bioleaching experiment in 50 mL slurry experiments.

The results from the experiments with coal are shown in FIGS. 4 and 5. The rate of mercury volatilization from the coal slurry phase into the gas phase in 50 mL experiment is shown in FIG. 4. It is observed that elemental mercury is present in the effluent gas, with the concentrations in the experimental samples being 4-5 fold higher than the control. The removal of mercury is linked to iron and pyrite oxidation and this was assessed by monitoring the concentration of iron and sulfate. The conversion of pyritic iron and sulfide present in the coal is shown in FIG. 5. The organism *A. ferrooxidans* is capable of iron as well as sulfide oxidation. Decrease in ratio of Fe(II) to total iron in experimental samples indicates the iron oxidation process. There was little change in the ratio for the control samples. Conversion of the sulfides to sulfate was observed in the experiment by occurrence of sulfate on day 5. The organism is known to oxidize sulfides to elemental sulfur. Formation of sulfate may have been chemically mediated by Fe(III), which is known to oxidize sulfides and thiosulfate to sulfate. Complete conversion of the pyritic sulfides to sulfate would result in increase in sulfate in the experimental samples by 1128 mg/L. An increase of about 800 mg/L was observed on day 5 in experimental samples compared to the control. It is known that as the ratio of Fe(III) to Fe(II) increases (equivalent to the redox potential), the oxidation process slows down. Secondly, release of mercury from coal and subsequent volatilization would occur only after all the sulfides are removed. Thus, a consistent increase in mercury removal is obtained following the 5 day period.

Figure 6:
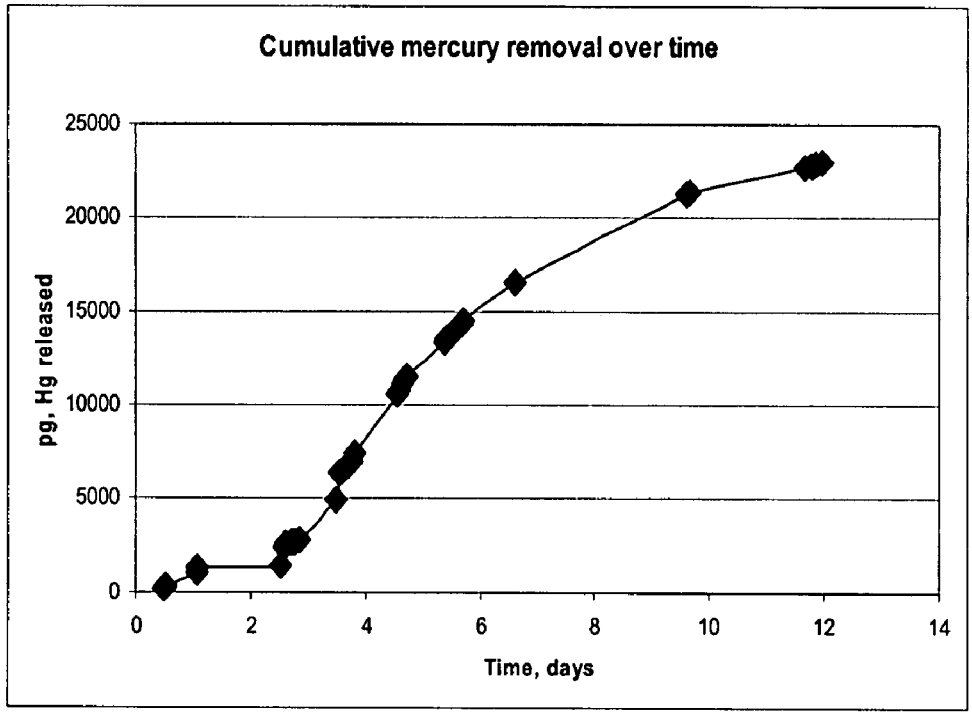
FIG. 6 is a graph showing the rate of mercury volatilization from coal into the gas phase in a 1 L slurry bioreactor.
Figure 7:
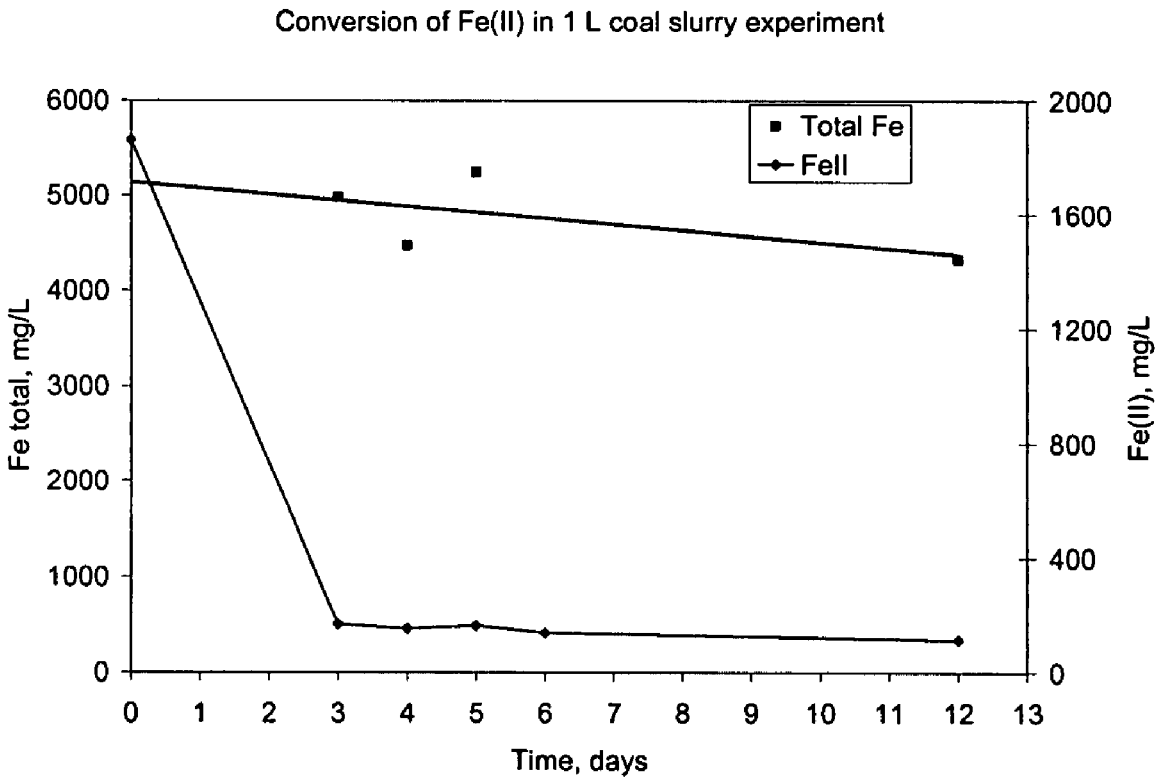
FIG. 7 is a graph showing the iron oxidation in liquid slurry phase during a coal bioleaching experiment observed by the drop in Fe(II) concentration in the 1 L slurry bioreactor.

The results of the experiment in 1 L volume are shown in FIGS. 6 and 7. Similar to the 50 mL experiment, the majority of the iron oxidation occurred within the first few days (FIG. 7). The mercury removal was observed beginning on day 1, but the highest rate was observed on day 4, after majority of the iron present in the bioreactor was oxidized. The mercury from the effluent gas was captured on gold traps. The flow rate of the air-$CO_2$ mixture gas sparging through bioreactor was towards the higher side of the rates recommended for the gold trap and it is possible that all the mercury in the gas phase was not captured in the traps. Thus, the rate of mercury volatilization could be higher than what was measured.

Thus the hypothesis was that *A. ferrooxidans*, which carries out iron and sulfur oxidation would oxidize pyritic iron and sulfides and convert it to Fe(III) and partially oxidized forms of sulfur. The partially oxidized sulfur and residual sulfides may be oxidized chemically by Fe(III) to sulfate. Mercury existing in coal is present in several forms, but mainly as mercuric or elemental mercury form. The mercuric ions released from coal after oxidation of the pyritic sulfur would be reduced by *A. ferrooxidans* to elemental mercury and the air being sparged into the coal slurry would strip the elemental mercury from the aqueous phase. This mercury would then be captured by resins or other traps from the effluent gas stream.

The results indicate that the microbial process is capable of releasing the mercury bound to coal, followed by its volatilization into the gas phase. Additionally, the potential for capture of the mercury from the gas phase via mercury traps was also demonstrated.

A process scheme for mercury removal from coal is shown in FIG. 1 for a heap process and in FIG. 2 for a slurry process. FIGS. 1 and 2 were described above. The difference between the two operations is the time taken for mercury removal and the cost, with the slurry process being faster but potentially costlier. In both the processes, the oxidized iron and sulfur in the leachate phase can be removed via pH adjustment and lime addition, if removal of iron and sulfate is desired. Thus, the process enables removal of pyritic sulfur and iron from coal as well. The process can also be used to remove mercury from coal tailings or coal mine runoff which is rich in pyrite and consequently containing high levels of mercury and other heavy metals. Additionally, other heavy metals (metals having an atomic weight greater than sodium), such as aluminum, arsenic, cadmium, chromium, lead, nickel and zinc, may also be removed in the process and may be separated from the leachate phase by way of basic hydroxide precipitation. The effluent gas containing mercury can be collected by a gas collection system similar to that employed in landfill gas collection systems and passed through the sorbent bed for removal of mercury. The mercury-free gas can then be recirculated with necessary make-up gas through the bioreactor for continuous mercury removal.

The temperature used for the process in the demonstration experiment was 30° C., however, the bioprocess can be operated anywhere from 4° C. to 95° C. using organisms which grow optimally at temperatures other than 30° C. For example, thermophilic organisms such as *Sulfolobus solfataricus* which operate between 50° C. and 80° C. can be used at these higher temperatures which would expedite removal of mercury from the coal by reducing dynamic sorption of mercury on organic sulfur present in coal.

Therefore, it can be seen that the invention provides a process for the removal of mercury from coal prior to combustion. The process is based on use of microorganisms to oxidize iron, sulfur and other species binding mercury within the coal, followed by volatilization of mercury by the microorganisms. The elemental mercury is stripped off by sparging gas and captured by a mercury recovery unit.

Although the invention has been described in considerable detail with reference to certain embodiments, one skilled in the art will appreciate that the present invention can be practiced by other than the described embodiments, which have been presented for purposes of illustration and not of limitation. Therefore, the scope of the appended claims should not be limited to the description of the embodiments contained herein.

What is claimed is:

1. A process for removing mercury from coal, the process comprising:

(a) contacting coal having iron, iron compounds, sulfur, and/or sulfur compounds and having associated mercury or mercury compounds with a liquid including microorganisms selected from the group consisting of iron-oxidizing bacteria, sulfur-oxidizing bacteria, and mixtures thereof, wherein the microorganisms are selected from the group consisting of *Acidithiobacillus ferrooxidans, Acidithiobacillus thiooxidans, Acidithiobacillus caldus, Leptospirillium ferrooxidans, Sulfolobus solfataricus*, and mixtures thereof;

(b) biooxidizing at least one of iron, iron compounds, sulfur, and sulfur compounds in the coal whereby mercury ions are released from the coal into the liquid;

(c) volatizing the mercury ions in the liquid into volatilized elemental mercury by the microorganisms; and (d) passing a first gas over the coal and/or into the liquid to release a second gas from the coal and/or liquid, the second gas including the volatilized elemental mercury.

2. The process of claim 1 wherein:

step (a) comprises contacting a heap of the coal with the liquid.

3. The process of claim 1 wherein:

step (a) comprises forming a slurry of the coal and the liquid.

4. The process of claim 1 further comprising:

(e)removing mercury from the second gas.

5. The process of claim 1 further comprising:

(e) recovering the volatilized mercury from the second gas.

6. The process of claim 5 wherein:

step (a) comprises contacting the coal with the liquid in an enclosed bioreactor, and step (e) comprises feeding a stream of the second gas from the enclosed bioreactor and through a mercury recovery unit selected from the group consisting of adsorption systems, ion exchange systems, condenser systems, gold-coated sand traps, and resin beds.

7. The process of claim 6 wherein:

the first gas includes a portion of treated second gas exiting the mercury recovery unit.

8. The process of claim 5 wherein:

step (a) comprises contacting the coal with the liquid in a bioreactor, and the process further comprises (f)removing effluent liquid from the bioreactor, (g)recovering sulfates and/or iron from the effluent liquid, and (h)returning the treated effluent liquid to the bioreactor.

9. The process of claim 8 wherein:

step (f) further comprises filtering the effluent liquid removed from the bioreactor.

10. The process of claim 5 wherein:

step (a) comprises contacting the coal with the liquid in a bioreactor, and the process further comprises (f) removing effluent liquid from the bioreactor, (g) recovering heavy metals from the effluent liquid, and (h) returning the treated effluent liquid to the bioreactor.

11. The process of claim 1 wherein:

step (a) comprises contacting the coal with the liquid in an enclosed bioreactor, and step (d) comprises passing a first gas over the coal and/or into the liquid by way of a sparging device located in the bioreactor.

12. The process of claim 1 wherein:

step (a) comprises forming a slurry of the coal and the liquid, and agitating the slurry.

13. The process of claim 1 wherein:

step (a) comprises contacting the coal with the liquid in a temperature range of about 4° C. to about 95° C.

14. The process of claim 1 wherein:

step (a) comprises contacting the coal with the liquid in an enclosed bioreactor including a gas collection system, and the process further comprises (e) feeding a stream of the second gas from the gas collection system through a mercury recovery unit to recover the volatilized mercury from the second gas.

15. The process of claim 1 wherein:

step (a) comprises contacting the coal with the liquid at pH of about 0.5 to about 6.

16. A process for removing mercury from coal, the process comprising:

(a) forming a heap including (i) coal having associated mercury or mercury compounds and (ii) a liquid including microorganisms selected from the group consisting of iron-oxidizing bacteria, sulfur-oxidizing bacteria, and mixtures thereof wherein the; microorganisms are selected from the group consisting of *Acidithiobacillus*

*ferrooxidans, Acidithiobacillus thiooxidans, Acidithiobacillus caldus, Leptospirillium ferrooxidans, Sulfolobus solfataricus*, and mixtures thereof;

(b) biooxidizing at least one of iron, iron compounds, sulfur, and sulfur compounds in the coal whereby mercury and/or mercury ions are released from the coal into the heap and mercury ions in the heap are volatilized into mercury;

(c) introducing a first gas into the heap to release a second gas from the heap, the second gas including volatilized mercury; and (d) feeding a stream of the second gas through a mercury recovery unit to recover mercury from the second gas.

17. A process for removing mercury from coal, the process comprising:

(a) forming a slurry including (i) coal having iron, iron compounds, sulfur, and/or sulfur compounds and having associated mercury or mercury compounds and (ii) a liquid including microorganisms selected from the group consisting of iron-oxidizing bacteria, sulfur-oxidizing bacteria, and mixtures thereof, wherein the microorganisms are selected from the group consisting of *Acidithiobacillus ferrooxidans, Acidithiobacillus thiooxidans, Acidithiobacillus caldus, Leptospirillium ferrooxidans, Sulfolobus solfataricus*, and mixtures thereof;

(b) biooxidizing at least one of iron, iron compounds, sulfur, and sulfur compounds in the coal whereby mercury ions are released from the coal into the slurry;

(c) volatizing the mercury ions in the liquid into volatilized elemental mercury by the microorganisms; and (d) introducing a first gas into the slurry to release a second gas from the slurry, the second gas including the volatilized elemental mercury; and (e) feeding a stream of the second gas through a mercury recovery unit to recover mercury from the second gas.

* * * * *